United States Patent [19]

Abura et al.

[11] 4,284,877

[45] Aug. 18, 1981

[54] ELECTRICALLY HEATED HAIR CURLER

[75] Inventors: Yoshinori Abura; Fumiya Ueda; Nobuyuki Morihara; Tomohiro Kami, all of Hikone, Japan

[73] Assignee: Matsushita Electric Works, Ltd., Osaka, Japan

[21] Appl. No.: 934,726

[22] Filed: Aug. 21, 1978

[30] Foreign Application Priority Data

Aug. 27, 1977 [JP] Japan ..... 52-103051

[51] Int. Cl.[3] ..... A45D 2/36; H05B 1/00

[52] U.S. Cl. ..... 219/222; 132/9; 132/33 R; 132/33 F; 132/40; 132/41 R; 219/242; 219/505; 219/541; 338/22 R; 338/328

[58] Field of Search ..... 219/222-225, 219/240-242, 504, 505, 541, 533; 132/7, 9, 33 R, 33 A, 33 B, 33 E, 33 F, 33 G, 36 R, 39, 40, 41 R, 41 A, 41 B, 41 C, 50 R, 50 A, 50 B; 338/22 R, 23, 328

[56] References Cited

U.S. PATENT DOCUMENTS

| | | | |
|---|---|---|---|
| 3,003,505 | 10/1961 | Otto et al. | 132/41 R |
| 3,250,895 | 5/1966 | McNair | 219/242 X |
| 3,375,774 | 4/1968 | Fujimura et al. | 338/22 R |
| 3,487,197 | 12/1969 | D'Elia et al. | 219/242 X |
| 3,488,471 | 1/1970 | Gstalder | 132/33 R |
| 3,515,851 | 6/1970 | D'Elia et al. | 219/242 X |
| 3,519,792 | 7/1970 | Solomon | 219/242 X |
| 3,559,658 | 2/1971 | Gemest et al. | 219/242 |
| 3,560,703 | 2/1971 | Chedister | 219/242 X |
| 3,586,820 | 6/1971 | Yamanaka | 219/242 X |
| 3,632,971 | 1/1972 | Flanagan | 219/242 X |
| 3,673,382 | 6/1972 | Gaffney et al. | 132/33 R X |

FOREIGN PATENT DOCUMENTS

| | | | |
|---|---|---|---|
| 1180242 | 12/1958 | France | 132/40 |
| 1128956 | 10/1968 | United Kingdom | 219/222 |

*Primary Examiner*—A. Bartis

*Attorney, Agent, or Firm*—Burns, Doane, Swecker & Mathis

[57] ABSTRACT

A hair curler comprising an elongated substantially hollow hair bobbin includes a PTC heating element having a temperature self-controlling function housed within the hair bobbin. A pair of opposed cup-shaped generally cylindrical members are housed within the bobbin with each cylindrical member including a bottom and a side wall. The heating element is held between the opposed bottoms of the cup-shaped members. Each of the bottoms of the cup-shaped members defines an electrode plate arranged in contact with a respective side of the heating element for transmitting electricity to the heating element and conducting heat from the heating element to the side wall of the respective member. The side wall of each member defines conductors for transmitting the heat to the ends of the hair bobbin. A power supplying pin includes first and second power supplying terminals which are connected to a respective one of the electrode plates. The power supplying pin further includes an insulator interposed between the terminals. One end of the power supplying pin extends in one direction through the heating element and both electrode plates for fastening the heating element and the electrode plates together. Another end of the pin extends in an opposite direction along a longitudinal axis of the hair bobbin toward an open end of the bobbin. The power supplying pin is accessible through the open end of the bobbin and is adapted to be connected to a power source.

15 Claims, 30 Drawing Figures

ELECTRICALLY HEATED HAIR CURLER

The present invention relates to a hair curler, and more particularly to a hair curler employing a heating element with temperature self-controlling function and a power supplying pin, wherein heating can be performed by plug-in operation to the source device.

Conventionally there have already been suggested hair curlers in which a temperature self-controlling heating element is placed in a hair bobbin. In such a hair curler, since a heating element and also an electrode of the heating element extend over the axial length of the hair bobbin, the hair curler is heavy the manufacturing cost is high and further the hair curler is likely to be heated at the axial end portion which is to be gripped during the use. In this hair curler, heat is transmitted uniformly over the hair bobbin in the axial direction and shortage of heat may occur in the center of the bobbin where hair is wound thicker. Further, as the electrode is obtained by coating, it is difficult to achieve electric, thermal and mechanical strength at the same time.

The present invention is proposed to eliminate the above-mentioned problems and comprises a hair bobbin, a PTC heating element with temperature self-controlling function housed in said hair bobbin, and heat conducting members disposed on opposite sides of the heating element. The heat conducting members include electrode plates arranged in electrical contact with the sides of said element and heat conducting parts extending substantially perpendicularly from the electrode plates to heat the inner periphery of the bobbin. Also provided is a power supplying pin comprising first and second power supplying terminals, said power supplying pin extending through said heating element and electrode plates to fasten the heating element between the electrode plates.

A principal object of the present invention is to provide a hair curler which is safe for use, of a long service life, of an improved heat efficiency and allows uniform heating of hair.

Another object of the present invention is to provide a hair curler allowing a quick heating to an appropriate temperature.

A further object of the present invention is to provide a hair curler which is light in weight, allows easy winding of hair and further allows easy attachment thereof to the hair with a hair clip.

A yet further object of the present invention is to provide a hair curler so constituted that the users' fingers should not touch the power supplying terminal and heat conductive member, and thereby no burning hotness is felt by the users.

A still further object of the present inventions is to provide a hair curler of which is excellent enough in the injection nature that the respective constituent parts are easily manufacturable by injection molding of a synthetic resin.

A still another object of the present invention is to provide a hair curler which is compact, allows easy connection to the socket terminals and avoids aberrations between the terminals.

A still further object of the present invention is to provide a hair curler having a high curling efficiency due to the concentration of heat in the central part in the axial direction of the hair bobbin.

Now the present invention shall be explained in detail by the preferred embodiments thereof shown in the attached drawings, in which.

Conventionally there have already been suggested hair curlers in which a temperature self-controlling heating element 101 is placed in a hair bobbin 102. In such a hair curler, since a heating element 101 and also an electrode 103 of the heating element extend over the axial length of the hair bobbin 102, the hair curler is heavy the manufacturing cost is high and further the hair curler is likely to be heated at the axial end portion which is to be gripped during use. In this hair curler, heat is transmitted uniformly over the hair bobbin in the axial direction and shortage of heat may occur in the center of the bobbin where hair is wound thicker. Further, as the electrode is obtained by coating, it is difficult to achieve electric, thermal and mechanical strength at the same time.

Figure 1:
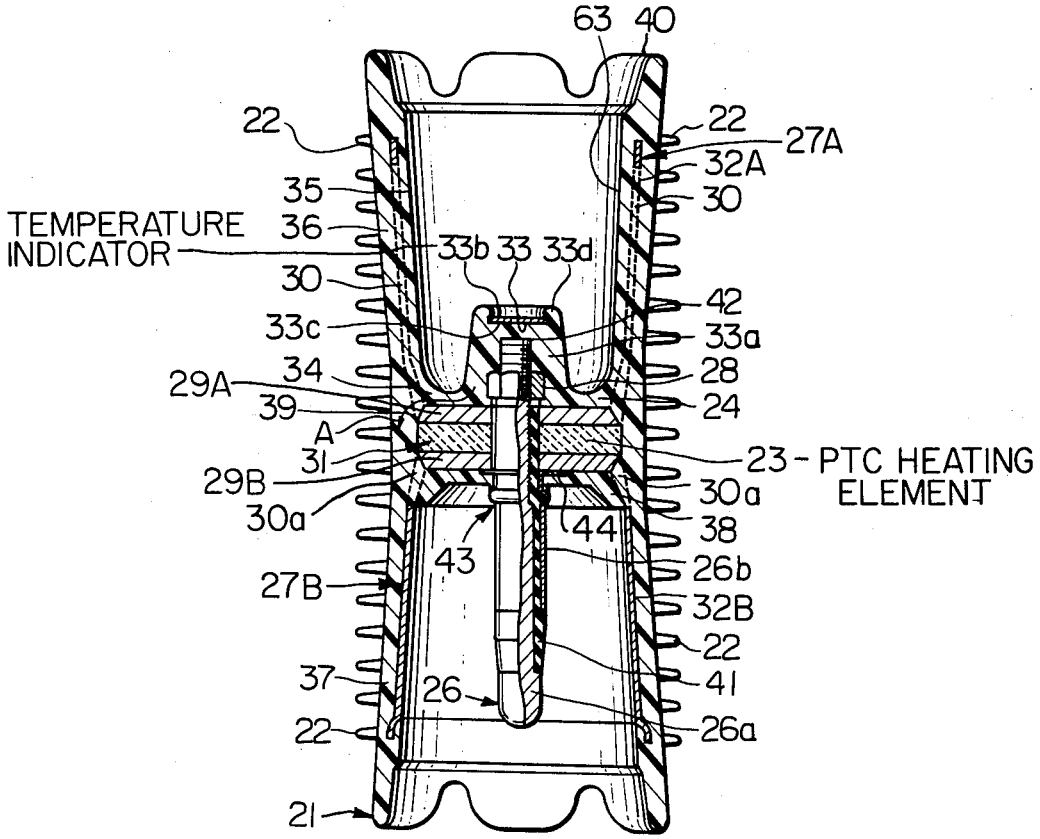
FIG. 1 is a cross-sectional view of an embodiment of a hair curler according to the present invention.

FIG. 1 shows an embodiment of the present invention, wherein a heating element 23 having a positive temperature coefficient of resistance is supported between (PTC) bottoms of a pair of opposing heat conductive cup-shaped or bottomed cylindrical members 27A, B. A supplying power pin 26 carrying power supply terminals for the heating element 23 is inserted from below through holes provided substantially in the center of the lower bottomed cylindrical member 27B, the heating element 23 and the upper bottomed cylindrical member 27A. The pin is fastened and fixed by means of a nut 28 and a flange 44. Thus the bottomed cylindrical members 27A, B, heating element 23 and power supplying pin are secured together to form an integrated heating assembly 31 around which is molded a synthetic resin. That is, a tubular hair bobbin 21 of synthetic resin is formed onto such heating element and is provided with a plurality of projections 22 on the outer peripheral surface thereof.

According to the present invention, the heating element 23 is disposed within a synthetic resin bobbin to prevent heat loss by radiation from the heating element 23 to the atmosphere and the like during the heating and to achieve prompt heat conduction from the heating element 23 to the external peripheral surface of the hair bobbin 21. Also the electric connection between the heating element 23 and the power supplying pin 26 is enclosed within a synthetic resin, which affords protection from water, cosmetics or gaseous materials and improves the reliability of electric connection, thus assuring stable electric contact even in a prolonged use.

As a method of holding the heating element 23 between the bottoms of a pair of bottomed cylindrical members 27A, B, instead of fastening with nuts as in the above embodiment, caulking and soldering can also be employed without departing from the spirit of the present invention. Thus, in the present invention the heating element is held strongly between the bottoms of a pair of bottomed cylindrical members 27A, B, and thereby the reliability of the electric connection is highly improved. Furthermore when the integrated heating element and bottomed cylindrical members are pressed and inserted into the hair bobbin, instead of being molded therein, or when these element and members are coated with a thermally shrunk silicone tube, it is also possible to supply a hair curler of a high reliability.

In the following there will be explained in detail the structure of each component part.

The heating element 23 is composed of a temperature self-controlling heating element (PTC heating element) such as a positive thermister, which, requiring neither a separate temperature controller such as a thermostat nor a mechanism for mechanical control, not only improves the reliability of temperature control but also achieves a compact and light structure.

Figure 2:
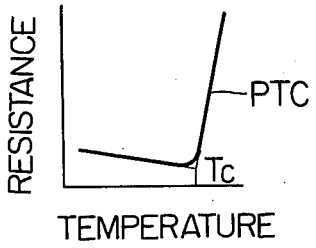
FIG. 2 is a chart showing the characteristics of a positive thermister to be employed in the present invention.

As shown in FIG. 2, the heating element 23 comprising a temperature self-controlling heating element such as a positive thermister, is characterized in that the resistance is relatively low below a switching temperature Tc, rather decreasing gradually from that under a normal temperature (about 20° C.), and increases rapidly above the switching temperature Tc. Because of these characteristics, when the heating element 23 is supplied with a given voltage, the temperature thereof will rise rapidly by the initially large power consumption but does not exceed a certain temperature due to a drop in the power consumption resulting from an increase of the resistance with the rise of temperature, whereby a constant temperature is maintained and thus a temperature control is performed by the element itself. In this manner, therefore, it is rendered possible, by the temperature control of the heating element 23 itself, to bring, through the bottomed cylindrical members 27A, B, the surface temperature of hair bobbin 21 to an appropriate temperature promptly and to maintain said temperature.

In the embodiment, as already explained in the foregoing, the heating element 23 is embedded in the partition 24 positioned in the center in the axial direction of the substantially hollow hair bobbin 21 having an H-shaped cross section, and the power supplying pin 26 electrically connected to said heating element 23 is positioned along the axial line to project only on one side of the heating element and within the end surface of said hair bobbin 21.

Figure 3:
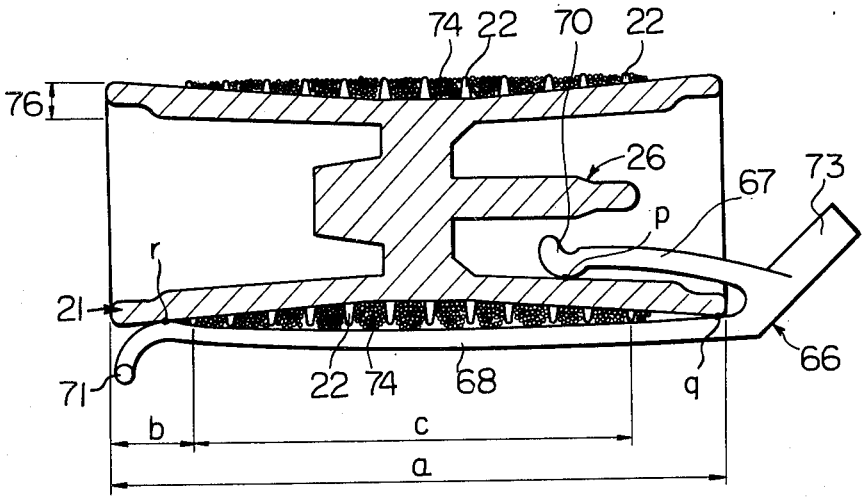
FIG. 3 is a schematic cross-sectional view showing a state wherein hair is wound around the hair curler.

Since the heating element 23 is positioned substantially in the center in the axial direction of the hair bobbin 21 and hair is usually wound thicker around the central part and thinner around the end portions, as shown in cross-sectional view in FIG. 3, during use of such a hair curler, the distribution of a higher and a lower temperature respectively in the center and in the end portions of the hair bobbin 21 meets the distribution of hair mentioned above. This creates a uniform transfer of heat required for hair curling irrespective of the thickness of hair wound around the curler, and consequently uniform and firm curling to the entire hair.

The bottomed cylindrical member 27A, B employed in the present embodiment is provided with a bottom face thicker than the side wall, in order to mechanically reinforce the contact with the heating element 23 comprising a temperature self-controlling heating element such as a positive temperature coefficient (PTC) thermistor, to achieve an effective heating of the heating element 23, and to achieve a heat accumulating effect in the central portion of the hair curler.

Both end portions in the axial direction of the pipe-shaped hair bobbin 21 extend beyond the peripheral walls of the bottomed cylindrical members 27A, B. The extending parts of the bobbin are made thinner, which serves to reduce the entire weight of the hair curler.

Now there will be explained the method of junction between said bottomed cylindrical member 27A or B and the heating element 23. The upper member 27A includes an electrode part 29A in contact with one side of the heating element 23, and a heat conducting part (or sidewall) 32A extending perpendicularly from the electrode plate part 29A. The lower member 27B includes an electrode plate part 29B in contact with the opposite side of the heating element 23, and a heat conducting part (or sidewall) 32B extending perpendicularly from the electrode plate part.

In case insufficient contact occurs between the heating element 23 and the pair of bottomed cylindrical members 27A, B to be contacted with the both sides of the element, or in case an insufficient thermal conduction arises in said members 27A, B the heating element 23 alone will rise in temperature causing power reduction, whereby the hair bobbin 21 and other parts of the hair curler having a large heat capacity require a longer time for generating heat of an appropriate temperature within the bobbin. Consequently it becomes necessary to improve the heat conduction from the heating element 23 to the bottomed cylindrical members 27A, B and also from said bottomed cylindrical members to other parts, in other words, the heat exchange between the respective members for allowing the heating element 23 to maintain the initial large power consumption.

In the present embodiment the bottoms of the members 27A, B are made thicker in order to realize stable contact and improve heat conduction and enable prompt heating.

Figure 4:
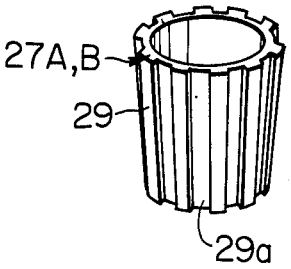
FIG. 4 is a perspective view of an embodiment of a bottomed cylindrical member to be employed in the present invention.
Figure 5:
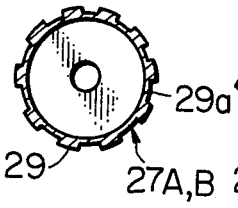
FIG. 5 is a horizontal cross-sectional view of the bottomed cylindrical member shown in FIG. 6.
Figure 6:
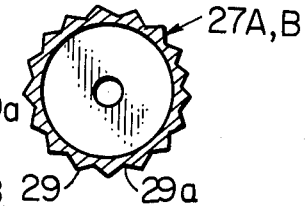
FIG. 6 is a horizontal cross-sectional view of another embodiment of the bottomed cylindrical member.
Figure 7:
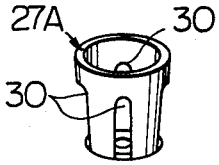
FIG. 7 is a perspective view of an embodiment of the bottomed cylindrical member for use in the present invention wherein the member is provided with through holes.
Figure 8:
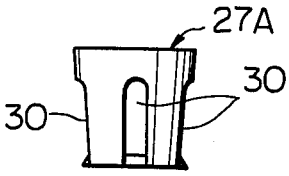
FIG. 8 is a side view of the bottomed cylindrical member shown in FIG. 7.

Further as to the details of the structure, the bottomed cylindrical members 27A, B are shaped in such a manner that the external surface area of the side wall thereof is larger than the internal surface area thereof. More specifically the side wall of said member 27A, or B is provided, on the external periphery thereof, with a series of projections and recesses 29 or **29*a* as shown in FIGS. 4 to 6. The presence of said projections and recesses 29 or 29*a* increases the heat radiation area to the external periphery on which hair is to be wound in comparison with the internal peripheral area. This increases the heat transfer from the members 27A, B to the hair winding portion of the synthetic resinous hair bobbin 21, thereby minimizing heat loss by radiation from the hair curler to the air and maximizing the heat radiation at the hair winding portion, thus achieving an effective hair curling with a light-weight hair curler. Also the presence of said projections and recesses 29, 29*a*, increases the cross-section coefficient even at a same cross section, improves the mechanical strength of said members 27A**, B and prevents deformation during the insert molding, part working and transportation, thus allowing further increase of strength and use of light structure.

Figure 9:
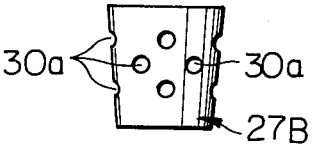
FIG. 9 is a side view of another embodiment of the bottomed cylindrical member.
Figure 10:
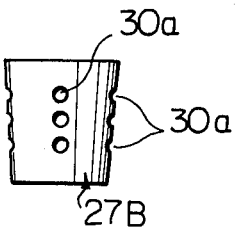
FIG. 10 is a side view of yet another embodiment of the bottomed cylindrical member.

The bottomed cylindrical member 27A or B to be insert molded with a synthetic resinous material is provided, on the side wall thereof, with through holes 30, **30*a* as shown in FIGS. 7 to 10. In an embodiment shown in cross-sectional view in FIG. 7 and in side view in FIG. 8, the upper bottomed cylindrical member 27A is provided with a plurality of elongate through holes 30 extending in the longitudinal direction of said member, in order to allow smooth flow of resin during the injection molding and also to prevent deformation or displacement of the side wall of said member resulting from injection pressure of resin. Also since the resin temperature at the injection is higher than the resin temperature during use of curler which is in turn higher than the room temperature, the above-mentioned structure functions, by means of contraction of resin by the above-mentioned temperature difference, to maintain the cylindrical member 27A and heating element 23 in pressure contact, thereby achieving a stable electrical contact. Also the use of circular through holes 30*a* in a checkerboard arrangement in the lower member 27B as shown in FIG. 9 or in a linear spaced arrangement as shown in FIG. 10** prevents any low-temperature zones resulting from the presence of said through holes, from being concentrated in particular directions, thereby realizing uniform temperature distribution at the curling and achieving uniform curling areas over the entire hair.

Now there will be explained the problems which will occur in the molding of synthetic resin. In the insert molding of a synthetic resinous material onto a heating assembly 31 consisting of the heating element 23 and bottomed cylindrical members 27A, B, the position of the injection molding gate should be carefully selected so as to (a) fill the material satisfactorily into the necessary portions around the members 27A, B of a special shape, (b) not cause displacement of the heating assembly 31 or deformation of sidewall 32A, B of the members 27A, B by the injection pressure, and (c) not leave the trace of a gate on the hair winding surface or end face of hair bobbin 21 which could result in eventual damage to the hair or fingers of the user. In consideration of these points, the injection gate is preferably located on the symmetrical axis of hair bobbin 21. This results in the prevention of damage to the hair and stability of inserted parts. However, the resin flow in this case, passing through quite a long path from the gate 33 to the upper inner bottom 34, then upper inner wall 35, upper outer wall 36 and to lower outer wall 37, tends to cause outward deformation of side-wall 32A or B of the member 27A or B due to the pressure difference between the upper inner wall 35 and upper outer wall 36, and is also incapable of molding the lower bottom face 38. In order to prevent these drawbacks while maintaining the gate 33 on the symmetrical axis, the through holes 30, **30*a* are provided in the side walls 32A, B of the bottomed cyllindrical members 27A, B. Said through holes 30, 30*a* divide the resin flow introduced from the gate 33 and passing through the upper bottom face 34 into the upper inner wall 35 and upper outer wall 36, thereby reducing the pressure difference therebetween to prevent deformation of side-wall 32A or B of the member 27A or B and also reduce the total length of flow path. Also the molding of lower bottom face 38 can be promptly achieved in this manner. The through holes 30, 30*a* are advantageously provided with inclined faces 39 at the ends thereof in order to realize a smooth resin flow in the direction A shown in FIG. 1, thereby achieving adequate resin filling. The gate position 33 on the symmetrical axis is effective not only in realizing a uniform resin flow and a well balanced molding with respect to the inserted components, but also in preventing the deformation of the members 27A, B in contrast to the case of positioning the gate for example on an end face wherein the least strong portion of the side wall of said members 27A, B is exposed to the highest injection pressure of the resin. Also in this manner the gate position 33 can be sufficiently recessed from the end portion 40 so that the eventual damage to the hairs and fingers can be prevented and the finishing of gate trace can be dispensed with in comparison with the case wherein the gate is for example positioned on the end portion of the hair bobbin 21**.

Now there will be explained the structure of power supplying pin.

The heating element 23 is maintained in contact with the bottoms of the cylindrical members 27A, B by means of the power supplying pin 26 composed of a first terminal 26*a*, an insulation 41 and a second terminal 26*b*, the upper end 42 of said first terminal 26*a* being fixed with a nut 28 or by caulking. In this arrangement there is employed an elastic member 43 in order to assure stable electrical contact between the heating element 23 and the bottom faces of said members 27A, B.

Figure 11:
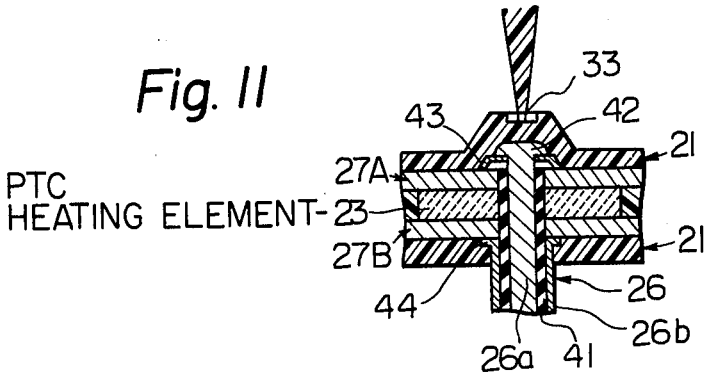
FIG. 11 is a cross-sectional view showing the conventional embedding position of an elastic member.

However, if said elastic member 43 is positioned on the gate side 33 as shown in FIG. 11, it may result that the end portion 42 of a first terminal 26*a* and the elastic member 43 are pushed downwards (i.e. in a direction opposite to the gate position) by the injection pressure to create unstable electrical contact between the second terminal 26*b* and the bottom of the lower cylindrical member 27B.

Figure 12:
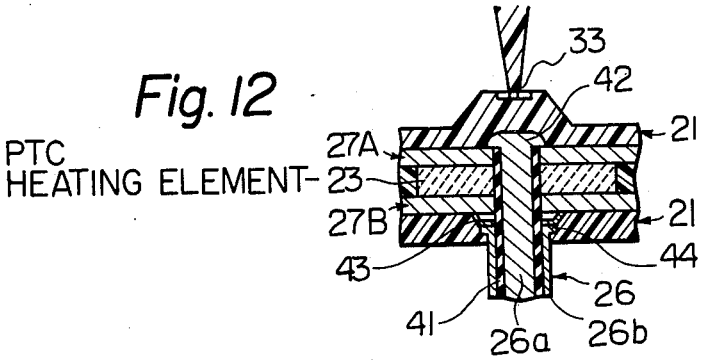
FIG. 12 is a cross-sectional view showing the embedding position of the elastic member according to the present invention.
Figure 13:
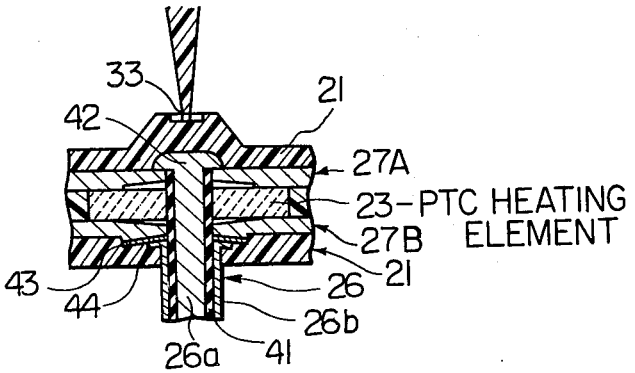
FIG. 13 is a cross-sectional view showing another embodiment thereof.

This drawback can be prevented by placing the elastic member 43, as shown in FIGS. 12 and 13, in a position opposite to the gate 33, namely between the bottom of the lower cylindrical member 27B and a flange 44 provided at the upper end of the second terminal 26*b*, and in this manner it is possible to prevent the deformation of the elastic member 43 resulting from the injection pressure of resin and to assure an electrically stable contact between the heating element 23 and the bottoms of two cylindrical members 27A, B by means of the elasticity of said elastic member 43.

Again referring to FIG. 1, in a projecting portion 33*a* formed on the partition 24 in the approximate center of the hair bobbin 21 corresponding to the gate position 33 and formed to cover the upper end of the first terminal 26*a* of the power supplying pin 26, there is provided a recess 33*c* for receiving a temperature-indicating layer 33*b* located opposite the upper end 42 of the first terminal 26*a*. Along the periphery of said recess 33*c* there is provided a protruding rim 33*d* so that the plate-shaped temperature-indicating layer 33*b* fitted into said recess 33*c* is prevented from dropping-out. As said recess 33*c* is sufficiently retracted from the end face of the hair bobbin 21, the temperature-indicating layer 33*b* is well protected from contact with fingers and from damage by fingernails when the hair is wound on the hair curler. The temperature-indicating layer 33*b* in this arrangement is capable of indicating a correct heating temperature of the hair curler without the effect of the atmospheric temperature even if it is varying, since said layer is located opposite the upper end 42 of the first terminal 26*a* which is connected directly with the heating element 23 and well retracted inside the hair bobbin 21.

In the embodiment shown in FIG. 1, the first terminal 26*a* and second terminal 26*b* are both provided coaxially with the hair bobbin 1. More specifically the power supplying pin 26 composed of the first terminal 26*a* surrounded by the insulator 41 and the second terminal 26*b* in succession, is located coaxial with the hair bobbin 21.

Now explained in the following is the heating device for use in combination with the hair curler of the foregoing embodiment.

Figure 14:
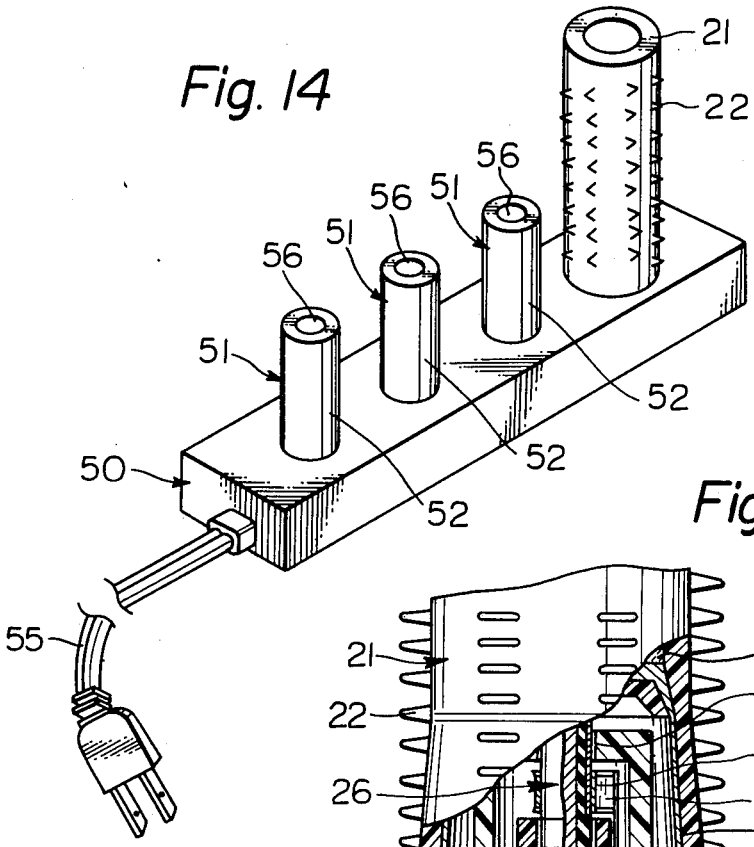
FIG. 14 is a perspective view of an embodiment of a heating device.
Figure 15:
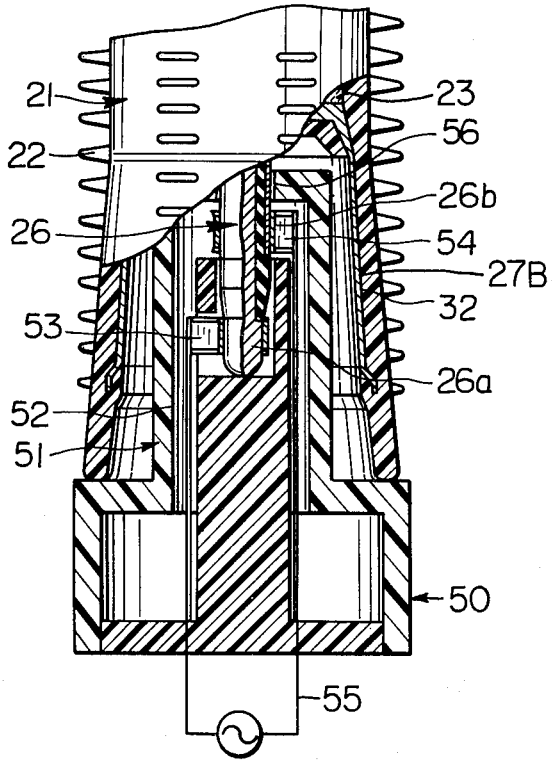
FIG. 15 is a partial cross-sectional view showing a state wherein the hair curler is connected to said heating device.

In order to supply electric power to the hair curler provided with the heating element 26 as shown in FIG. 1, there is employed a heating device 50 as shown in FIG. 14 and 15, which is formed of an insulating material and provided with plural sockets 51 each consisting of a projecting member 52 on which the hair curler is to be fitted, said projecting member 52 being provided therein with terminals 53, 54, respectively, corresponding to the first and second terminals 26*a*, 26*b* of the hair curler, said terminal 54 being connected to the power supply cord 55. The upper end face of said projecting member 52 is provided, in the center thereof, with an opening 56 for receiving the power supplying member 26 comprising the first terminal 26*a*, insulator 41 and second terminal 26*b*. The terminals 53, 54 are positioned inside a socket 51 and kept from contact of fingers. In case of heating the hair curler, the power supplying pin 26 is fitted into said opening 56 of the projecting member 52 of the socket 51 to electrically connect the first and second terminal 26*a*, 26*b* respectively with the terminals 53, 54 of socket 51, whereby the heat generated by the heating element 23 is transmitted to and accumulated in the bottomed cylindrical members 27A, B and further transmitted the hair bobbin 21 for performing curling when the hair is wound thereon. In this arrangement the hair curler can be rendered compact by providing the first and second terminals 26*a*, 26*b* and insulator 41 coaxially. Also by providing the composed power supplying pin satisfactorily recessed from the end face of the hair bobbin 21, it is rendered possible to avoid contact of fingers with said pin even when the finger is inserted inside the hair bobbin during the hair winding operation. Further, in contrast to the ordinary case wherein supplying pins are two in number, which requires an adequate positioning of the hair curler before fitting the same into the socket, the above-mentioned coaxial structure of the power supplying pin 26 and hair bobbin allows simple fitting of the hair curler in a single operation with simultaneous connection of the first and second terminals 26*a*, 26*b* of the power supplying pin 26 with the terminals 53, 54 of the socket 51 by utilizing the internal surface of the bobbin as a guide over the projecting member 52 of the socket 51 provided on the heating device 50.

Figure 16:
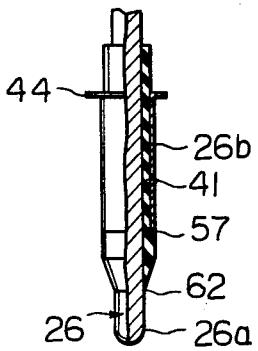
FIG. 16 is a partial cross-sectional side view showing the basic structure of a power supplying pin to be employed in the present invention.
Figure 17:
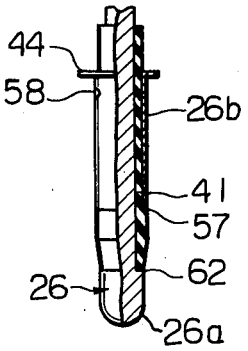
FIG. 17 is a partial cross-sectional side view of an embodiment of said power supplying pin.
Figure 18:
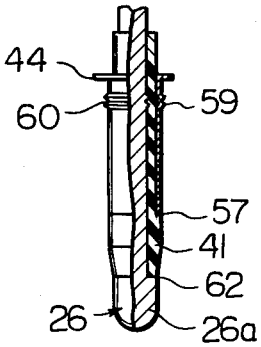
FIG. 18 is a partial cross-sectional side view of another embodiment of said power supplying pin.
Figure 19:
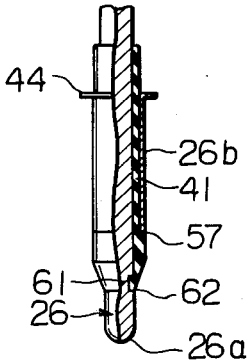
FIG. 19 is a partial cross-sectional side view of still another embodiment of said power supplying pin.

FIG. 16 shows the basic structure of the coaxial arrangement of the first terminal 26*a*, second terminal 26*b* and insulator 41, in which, however, there may result a mutual displacement between the first and second terminals 26*a* and 26*b* when the heating element is connected thereto. This is because the second terminal 26*b*, being made of a thin plate material, may undesirably engage, at the end portion 57 thereof, into the insulator 41. It is therefore preferable to provide an opening 58 on the second terminal 26*b* as shown in FIG. 17, or to provide annular projections 59 on the second terminal 26*b*, to provide knurling on the internal surface thereof or to provide surface irregularities 60 on the first terminal 26*a* as shown in FIG. 18, or to provide a recess 61 on the tip portion of first terminal 26*a* as shown in FIG. 19, thereby creating a force transmission between the first and second terminals 26*a*, 26*b* through the insulator 41 to prevent the above-mentioned mutual displacement and to achieve electrically stable connections. Also in the above-mentioned structure the undesirable engagement of the end portion 57 into the insulator 41 can be prevented as said end portion 57 of second terminal is maintained free from any pressure. Furthermore it is possible to prevent the play of components resulting from the difference in the dilatation and contraction thereof in the repeated heating and cooling of hair curler if the irregularities, openings and the like shown in FIGS. 17 and 18 are located satisfactorily close to the flange 44 provided at the upper end of the second terminal 26*b*. In the embodiment shown in FIG. 16 the tip portion 62 of the insulator 41 made of a synthetic resin is formed pointed to function as a guide for properly positioning the terminal 54 of the socket 51, so that said end portion is apt to be chipped off during the fitting of hair curler onto the socket 51 or detaching therefrom thereby rendering the smooth operation difficult. However the presence of recess 61 at the tip portion of first terminal 26*a* as shown in FIG. 19 allows an increase in the strength of the tip portion 62 of insulator 41, and the engagement of insulator 41 with said recess 61 enables an increase in the strength without affecting the function of said insulator as the guide for the socket terminal 54.

As a plurality of hair curlers are usually used for achieving hair curling, the hair curler is required to be of a light weight in order to reduce the weight applied to the head of a user as far as possible and to be of a structure firmly fixable to the head of a user. In the hair curler of the embodiment shown in FIG. 1 comprising bottomed cylindrical members 27A, B and also a temperature self-controlling heating element 23, a resin layer is advantageously formed on the external periphery of said cylindrical members 27A, B in order to form projections 22 for hair winding around the hair bobbin 21, but the presence of a resin layer inside the cylindrical members 27A, B is not desirable for reducing the weight of the hair curler though it is effective for increasing the heat capacity of the entire hair curler. It is therefore desirable, for the purpose of producing a hair curler of a reduced weight, to eliminate the resin layer inside the cylindrical members 27A, B. However, said members 27A, B, functioning also as the electrode for the heating element 23, are electrically charged when electric power is supplied to said heating element 23 for heating thereof, and is therefore dangerous to human beings and other animals if exposed to the outside. In this embodiment, therefore, the upper cylindrical member 27A is provided with an internal insulating wall 63 for safety while said wall is dispensed with in the lower part for achieving a light weight as shown in FIG. 1, since the lower cylindrical member 27B is protected from direct contact with the fingers and the like by the insulating projecting member 52 of the socket 51 and the lower external periphery of the hair bobbin 21.

Also such structure with exposed internal surface of the lower cylindrical member 27B enables, in the insert molding, a more positive positioning of the heating block 31 consisting of the heating element 23 which is held on both sides by the pair of bottomed cylindrical members. In case of covering the entire surface of the cylindrical members 27A, B with a synthetic resin in an insert molding, said block has to be maintained in position in a metal mold by means of the power supplying pin, and the positioning of said block is inevitably unstable as it is to be supported by the thin power supplying pin. In contrast, in the embodiment shown in FIG. 1 wherein the resin layer is absent in the lower internal face of the cylindrical members 27A, B the positioning of said block in the metal mold is rendered stable as said block can be supported in a wider area by maintaining not only the power supplying pin but also the internal face of the lower cylindrical member 27B in direct contact with the metal mold.

In the embodiment shown in FIG. 1, the length of the portion provided with hair winding projections 22 is rendered substantially equal to the distance between the ends of cylindrical members 27A, B which are insert molded in the hair curler. This structure corresponds to the usual habit of hair winding around a hair curler, wherein the hair is generally wound so as to leave the end portions of hair curler empty which are utilized for holding with fingers, as shown in FIG. 3. The total length a of the hair curler and the length b of end portion where the hair is not wound, are generally in the range of 60 to 70 mm and 5 to 10 mm, respectively.

In order to effectively transmit heat to the hair and also to facilitate manipulation of hair curler at the hair winding, it is desirable to elevate the temperature in the hair winding portion c shown in FIG. 3 and to lower the temperature in the holding portions b also shown in FIG. 3.

The object of the present invention, therefore, is to provide a hair curler which allows easy manipulation without burning fingers and still enables effective hair curling, and which is of a reduced weight achieved by minimizing the length of metal parts.

As shown in FIGS. 1 and 3 the hair winding projections 22 are provided in the hair winding portion (represented by c in FIG. 3), and the end faces of bottomed cylindrical members 27A, B are positioned so as to substantially coincide with the positions of outermost projections 22. Thus the hair curling is achieved by the heat supplied sufficiently from the side walls of said cylindrical members 27A, B to the internal surface of the hair bobbin 21 made of a synthetic resin. In this case, the end portions of hair curler do not reach as high temperature since said portions are composed of a synthetic resin whose heat conduction coefficient is far smaller than that of a metal, so that the user can perform hair winding without feeling heat.

In the following there will be given an explanation on the shapes of a hair clip and hair curler to be employed in the present invention.

Figure 20:
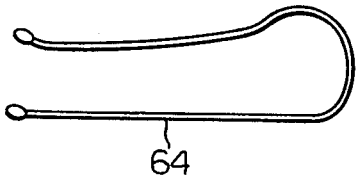
Fig. 20 PRIOR ART
FIG. 20 is a side view of an example of conventional hair clips.
Figure 21:
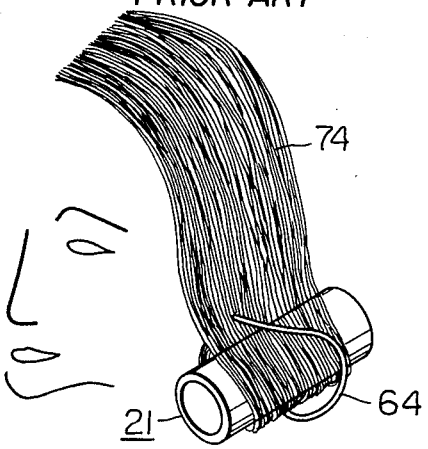
Fig. 21 PRIOR ART
FIG. 21 is a perspective view showing said conventional hair clip of FIG. 20 in use.
Figure 22:
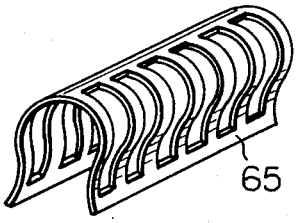
Fig. 22 PRIOR ART
FIG. 22 is a perspective view showing another example of conventional hair clips.
Figure 23:
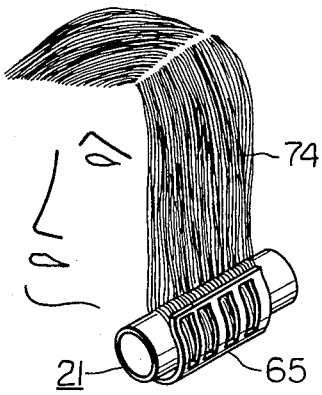
Fig. 23 PRIOR ART
FIG. 23 is a perspective view showing said conventional hair clip of FIG. 22 in use.
Figure 24:
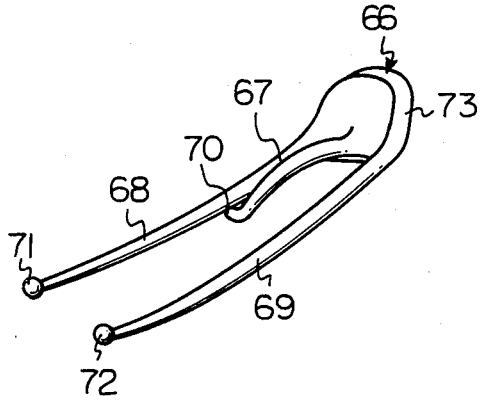
FIG. 24 is a perspective view of a hair clip to be employed in the present invention.
Figure 25:
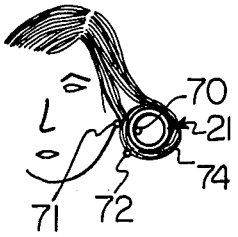
FIG. 25 is an explanatory drawing showing an example of use thereof.

Conventionally, the hair curler is fixed to the hair by means of a hair clip 64 or 65 as shown in FIGS. 20 or 22, in a manner as shown in FIGS. 21 or 23. However a two-legged clip as shown in FIG. 20 is defective in that the hair clip is only unstably fixed to the hair. On the other hand the hair clip 65 shown in FIG. 22 is defective in that it is too heavy, though it allows stable fixation. In order to solve the above-mentioned drawbacks, there has been suggested, in the present invention, a three-legged hair clip 66 shown in FIG. 24 comprising two longer legs 68, 69 extending in parallel from a tab portion 73. A third center leg 67 is positioned between said two legs 68, 69 and extends from said tab portion 73 for hair curling. The clip is integrally formed of a synthetic resin and the tab is inclined with respect to said two legs 68, 69. The two longer legs 68, 69 are provided at the respective ends thereof with spherical guides 71, 72 while said center leg 67 is provided at the end thereof with a spherical guide 70. As shown in FIGS. 3 and 25, said center leg 67 is guided by the thin part of the hair bobbin end portion and inserted inside the hair curler while the other two legs 68, 69 being positioned outside the hair curler to support the hair.

Figure 26:
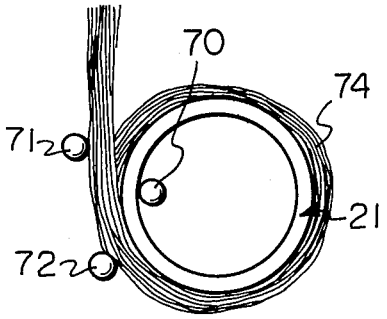
FIG. 26 is an explanatory drawing showing another example of use of said hair clip.
Figure 27:
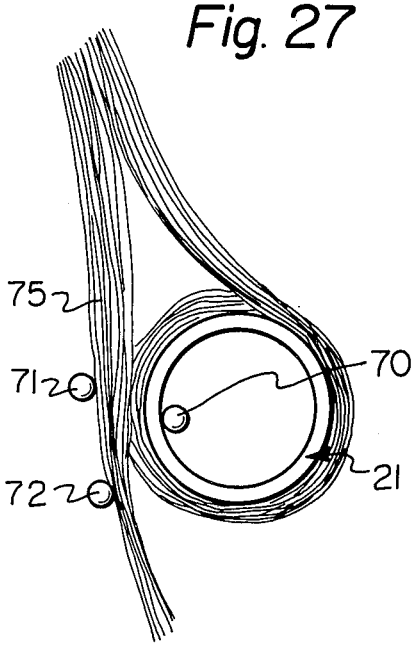
FIG. 27 is an explanatory drawing showing still another example of use of said hair clip.

The hair clip 66, when inserted after the hair is wound around the hair curler as shown in FIG. 26, fixes the hair by means of the elasticity of the two legs 68, 69 which are bent and separated from the center leg 67. However, a clip with a wider distance between three legs is also employable in case the hair curler is to be fixed with respect to the uncurled hair 75 as shown in FIG. 27. In both cases the triangular arrangement of the three supporting points p, q, r (see FIG. 3) positioned on the guides 70, 71, 72 of three legs provides stable fixation of hair curler to the hair. Furthermore, in contrast to the hair clips 64, 65 shown in FIGS. 20 and 22 which have to be shaped to correspond to the diameter of the hair curler, the hair clip 66 of the present invention shown in FIG. 24 is commonly usable with hair curlers of different diameters as long as the wall thickness 76 thereof is approximately same. More specifically, in relation to the different curvatures in different diameters of the hair curlers, an improved fixation can be achieved for the same hair clip if the wall thickness is made larger for a smaller diameter of hair curler and vice versa, but in practice this difference is negligible for the usual range of diameter of hair curler, for example from 15 to 60 mm.

In the present invention, however, this drawback is eliminated as the heating element 23 is positioned in the center as shown in FIG. 1 and the openings on both ends are shaped substantially the same. This allows the center leg 67 of the hair clip 66 to be inserted from either end, thus allowing full utilization of the advantage of said three-legged hair clip 66.

Figure 28:
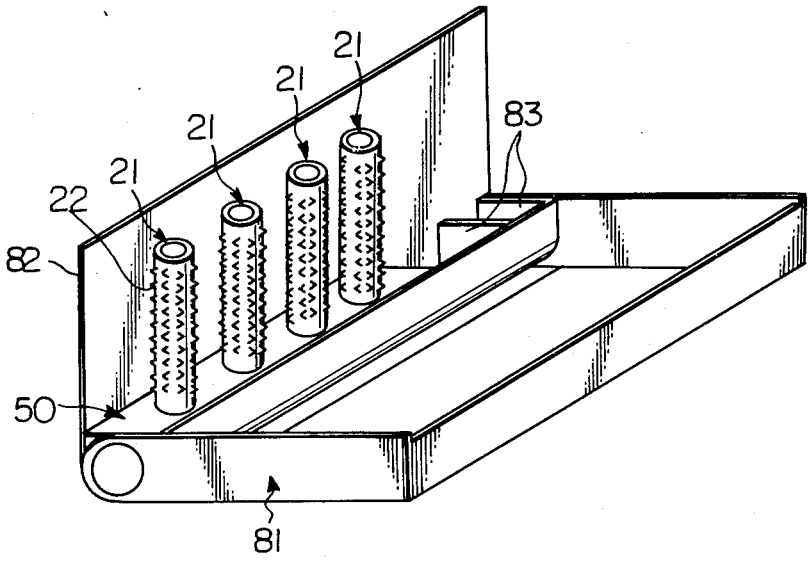
FIG. 28 is a perspective view showing a state wherein the hair curlers of the present invention are placed in a case.
Figure 29:
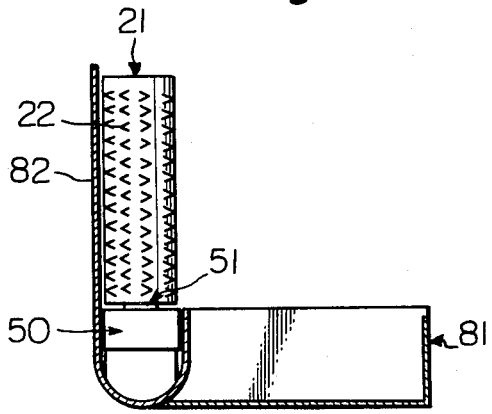
FIG. 29 is a cross-sectional side view of said case.
Figure 30:
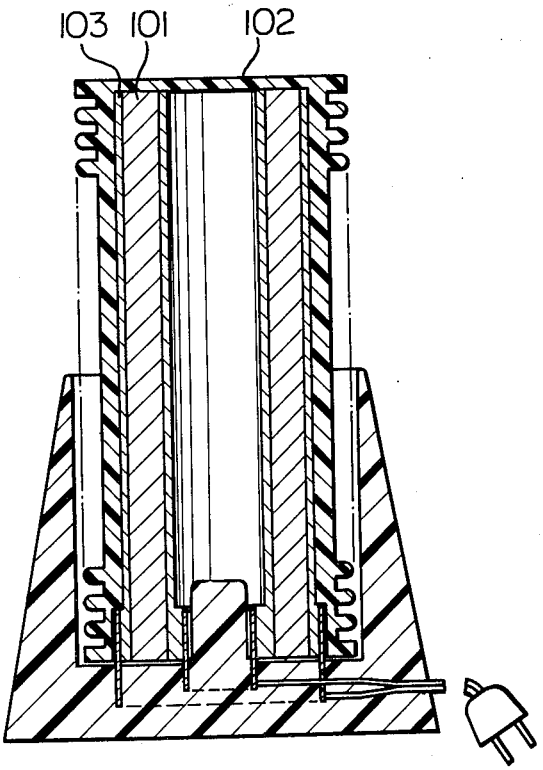
Fig. 30 PRIOR ART
FIG. 30 is a cross-sectional view of a conventional hair curler.

FIGS. 28 and 29 show a case 81 including compartments for storing a heating device 50 to be rotated with a lid 82 and hair clips 66. During use, the lid 82 is opened and the hair curlers of the present invention are plugged on the sockets 51 for heating, while, when not in use, the hair curlers are accomodated in the case 81 in a state in which they are still mounted on the sockets 51 by simply closing the lid 82.

Since in the present invention the structure of the hair curler wherein the heating element comprises a temperature self-controlling heating element and housed within the hair bobbin which is made of a synthetic resin has been improved as mentioned above, the present invention can provide a hair curler which is small in size, of a light weight, safe in use and of a long service life, and further of a high reliability because any separate temperature controller such as a thermostat and any other mechanical controllers can be dispensed with.

The present invention, wherein the hair curler comprises a hair bobbin, a heating element having a temperature self-controlling function to be housed in said hair bobbin, electrode plates arranged to be in contact with both sides of said heating element and a power supplying pin comprising first and second power supplying terminals which are connected to said electrode plates, said power supplying pin piercing said heating element and electrode plates for holding and fastening the heating element and said electrode plates together so as to arrange the element in the center in the axial direction of the hair bobbin, has achieved a hair curler in which the weight thereof is highly reduced, the heat capacity in the center in the axial direction of the hair bobbin is increased for achieving an efficient hair curling and obtaining the electrical, thermal and mechanical strength and the safety in use.

Also the use of a pair of bottomed cylindrical members of a cup shape on both sides of said heating element allows prompt heating of the hair bobbin to an appropriate temperature and enables uniform hair curling.

What is claimed is:

1. A hair curler comprising an elongated hair bobbin including an opening at one end, a PTC heating element having a temperature self-controlling function housed in said hair bobbin and including two opposing sides, a pair of opposed cup-shaped generally cylindrical members housed in said bobbin, each cylindrical member including a bottom and a side wall, said heating element being held between the opposed bottoms of said cup-shaped members, each of said bottoms defining an electrode plate arranged in contact with a side of said heating element for conducting heat from said heating element to the side wall of each member, the latter defining heat conductors for transmitting the heat of the heating element to the hair bobbin, and a power supplying pin comprising first and second power supplying terminals which are connected to a respective one of said electrode plates and an insulator interposed between said terminals, one end of said power supplying pin extending in one direction through said heating element and electrode plates for fastening the heating element and said electrode plates together and another end of said pin extending in an opposite direction along a longitudinal axis of the hair bobbin toward said opening of the bobbin, said pin being accessible through said opening and being adapted for connection to a power source.

2. A hair curler according to claim 1, wherein said PTC heating element is disposed substantially centrally between the axial ends of said bobbin, and extends radially outwardly from the axis of said bobbin substantially to the periphery of the bobbin.

3. A hair curler comprising:

an elongated substantially hollow hair bobbin opened at both ends in the axial direction, a PTC heating element housed in said hair bobbin intermediate said ends, said heating element including opposite side faces disposed toward said ends, first and second heat conducting members, each member comprising an electrode plate part and a heat conductor part extending substantially perpendicularly from said electrode plate part, said electrode plate parts of said first and second heat conducting members being held in electrical contact with respective ones of said side faces of said heating element to retain said element between said electrode plate parts, each of said heat conductor parts of said first and second heat conducting members extending away from the electrode plate part thereof substantially along an inner periphery of said hair bobbin toward opposite ends of the bobbin, and means for supplying electric power to said electrode plate parts and therethrough to said heating element to generate heat therein, said heat generated being transmitted from the heating element through the respective electrode plate parts and heat conductor parts of the first and second heat conducting members to the hair bobbin, said power supplying means comprising:

a first electrical power supply terminal having:

a first end extending through both of said electrode plate parts and said heating element and being electrically connected with a first of said electrode plate parts, and electrically insulated from a second of said electrode plate parts and said heating element, and a second end extending away from said second electrode plate part in the axial direction of said bobbin, a second electrical power supply terminal having:

a first end electrically connected to said second electrode plate part, and a second end extending away from said second electrode plate part alongside said second end of said first terminal and electrically insulated therefrom, said second end of the first and second electrical power supply terminals being accessible through one of said open ends of the bobbin and being adapted for connection to a power source.

4. A hair curler according to claim 3, wherein said electrode plate part and heat conductor part of each of said first and second heat conducting members are integrally formed to define a cup shape, wherein the electrode plate part forms a bottom and the conductor part forms a side wall of each cup shape.

5. A hair curler according to claim 4, wherein said hair bobbin is formed of a synthetic resin molding covering the outer peripheries of said sidewalls of said cup-shaped heat conducting members, and extending beyond both ends of said sidewalls, the portions of said bobbin extending beyond said sidewalls being thinner than the remainder of the bobbin covering the sidewalls.

6. A hair curler according to claim 5, in combination with a hair clipping means detachably mounted to the curler for holding the user's hair wound on said bobbin, said clipping means comprises a tab, a pair of elongated generally parallel legs extending from sides of said tab and a shorter leg extending from the center of the tab between said elongated legs, said shorter leg being bent so as to initially engage the inner periphery of the thinner portion of the bobbin while the elongated legs engage the outer periphery of the bobbin and thereafter engage the thicker portion of the bobbin.

7. A hair curler according to claim 4, wherein said bottoms are thicker than said sidewalls.

8. A hair curler according to claim 3, wherein said hair bobbin is integrally molded of a synthetic resin onto said heat conducting members, heating element and portions of said power supplying means.

9. A hair curler according to claim 8, wherein said electrode plate part and heat conductor part of each of said first and second heat conducting members are joined integrally into a cup shape, the bottom of which comprises the electrode plate part and the sidewall of which comprises the heat conductor part, each sidewall being provided with apertures for allowing a synthetic resin molding material of said hair bobbin to flow therethrough during bobbin formation.

10. A hair curler according to claim 3, wherein said second ends of said first and second terminals extend toward and terminate inside one of the ends of the bobbin.

11. A hair curler according to claim 10 in combination with a socket for transmitting electric power from a power source to said first and second power supply terminals when the curler is detachably mounted to said socket, said socket comprising a projection having an opening at an end thereof for receiving said power supplying means of the curler, and first and second terminals disposed within said projection and connected to the power source, said first and second terminals being adapted to be electrically connected to said first and second supply terminals of the power supplying means of the curler.

12. A hair curler according to claim 3, wherein said heating element is disposed substantially centrally of the axial extent of said bobbin.

13. A hair curler according to claim 3, wherein said power supplying means comprises a coaxial terminal pin, said first supply terminal defined by an inner terminal of said pin and said second supply terminal defined by an outer terminal disposed around said inner terminal and insulated therefrom by an insulative layer, said first end of said first terminal and said first end of said second terminal provided with means for securing together said first and second electrode plate parts and said heating element.

14. A hair curler according to claim 3, wherein said electrode plate part and heat conductor part of each of said first and second heat conducting members are joined integrally into a cup shape, the bottom of which comprises the electrode plate part and the side wall of which comprises the heat conductor part, said hair bobbin being formed of a synthetic resin molding, the location at which said resin is poured during the molding operation being arranged on the axis of said bobbin adjacent said electrode plate part of the first heat conducting member, and said bobbin being provided with an elastic member disposed between the first end of the second supply terminal and said electrode plate part of the second heat conducting member to maintain electrical contact between the first end and the electrode plate part.

15. A hair curler according to claim 14, wherein a temperature indicating layer is arranged to cover said pouring location of said resin molding in the finished bobbin.

* * * * *